US005456319A

United States Patent [19]

Schmidt et al.

[11] Patent Number: 5,456,319

[45] Date of Patent: Oct. 10, 1995

[54] APPARATUS AND METHOD FOR BLOCKING WELL PERFORATIONS

[75] Inventors: Joseph H. Schmidt; James C. Abel, both of Anchorage; Curtis G. Blount, Wasilla; Keith R. Ferguson, Anchorage; Michael J. Bolkovatz, Eagle River, all of Ak.

[73] Assignee: Atlantic Richfield Company, Los Angeles, Calif.

[21] Appl. No.: 282,685

[22] Filed: Jul. 29, 1994

[51] Int. Cl.[6] ..... E21B 43/00

[52] U.S. Cl. ..... 166/373; 166/386; 166/192

[58] Field of Search ..... 166/296, 373, 166/374, 381, 386, 387, 63, 153, 181, 192, 383, 385, 117, 195

[56] References Cited

U.S. PATENT DOCUMENTS 4,972,906 11/1990 McDaniel ..... 166/295 X

*Primary Examiner*—William P. Neuder

*Attorney, Agent, or Firm*—Michael E. Martin

[57] ABSTRACT

Perforations and cracks in wellbore liners or casings may be temporarily or permanently covered by a radially-expansible, coiled sleeve member formed by a sheet of elastically-deflectable material such as stainless steel which is coiled and placed in a cylinder which may be conveyed into a well to a working position for deployment of the sleeve to expand into engagement with the casing wall to block the perforations or cracks. The cylinder includes a sleeve ejecting piston which may be urged to rapidly eject the sleeve from the cylinder by pressure fluid conveyed to the cylinder by coilable tubing or by a gas-generating charge material electrically connected to an E-line which also may be used to deploy the cylinder into its working position in the well.

14 Claims, 2 Drawing Sheets

APPARATUS AND METHOD FOR BLOCKING WELL PERFORATIONS

BACKGROUND OF THE INVENTION

1. Field of the Invention

The present invention pertains to an apparatus which may be inserted in a wellbore and operated to provide a barrier between the well and perforations in the wellbore casing so that fracturing or other wellbore operations may be carried out at intervals either above or below the blocked perforations.

2. Background

In certain wellbore operations, where the well casing has already been perforated at a particular zone in an earth formation, it is sometimes desired to block these perforations, either permanently or on a temporary basis, while wellbore operations are carried out at intervals either above or below the interval which is to be blocked from communicating with the well. For example, when it is desired to perform certain stimulation techniques such as fracture initiation or extension into an earth formation zone below a zone which has already been placed in communication with the well by wellbore casing perforations, it is difficult to block off the upper set of perforations while the fracturing or other stimulation technique is carried out in the lower zone.

However, the present invention provides a unique apparatus and method for permanently or temporarily blocking a set of casing perforations to prevent communication between the wellbore and an earth formation adjacent the perforations.

SUMMARY OF THE INVENTION

The present invention provides a unique apparatus for blocking a set of wellbore perforations extending through a casing or liner wall and in communication with a particular zone of an earth formation.

In accordance with one important aspect of the present invention, an elongated coilable sleeve is placed in the well adjacent the portion of the casing in which casing perforations are formed and the sleeve is allowed to elastically uncoil into firm engagement with the inner wall of the casing to substantially block fluid communication between the casing perforations and the wellbore.

In accordance with another important aspect of the invention, an apparatus is provided for deploying a perforation blocking sleeve in a well, which apparatus may comprise a cylindrical housing for at least partially containing the sleeve and a pressure fluid actuator for deploying the sleeve from the housing to allow the sleeve to uncoil or unwrap into engagement with the wellbore casing to block communication between the wellbore and a particular earth formation zone through a set of casing perforations. The pressure fluid actuator may be connected to a coilable or jointed tubing string for deployment into its working position and retrieval therefrom. The actuator may also be deployed in a well on a signal conducting cable or so-called E-line and operated to deploy the perforation blocking sleeve from the actuator by a gas-generating device, a motor driven pump or a suitable electrically energized activator, such as an explosive bolt that releases a spring for urging deployment of the sleeve.

The present invention further provides a unique method for blocking a set of wellbore perforations which includes the steps of deploying an elastically coiled and expandable sleeve member in a position in a well which will allow the sleeve member to expand into engagement with the wall of a well casing to block a set of perforations or a crack, void or other opening in the casing to prevent fluid communication between the wellbore and an earth formation.

Those skilled in the art will recognize the above-described features and advantages of the invention together with other important aspects thereof upon reading the detailed description which follows in conjunction with the drawing.

DESCRIPTION OF PREFERRED EMBODIMENTS

Figure 1:
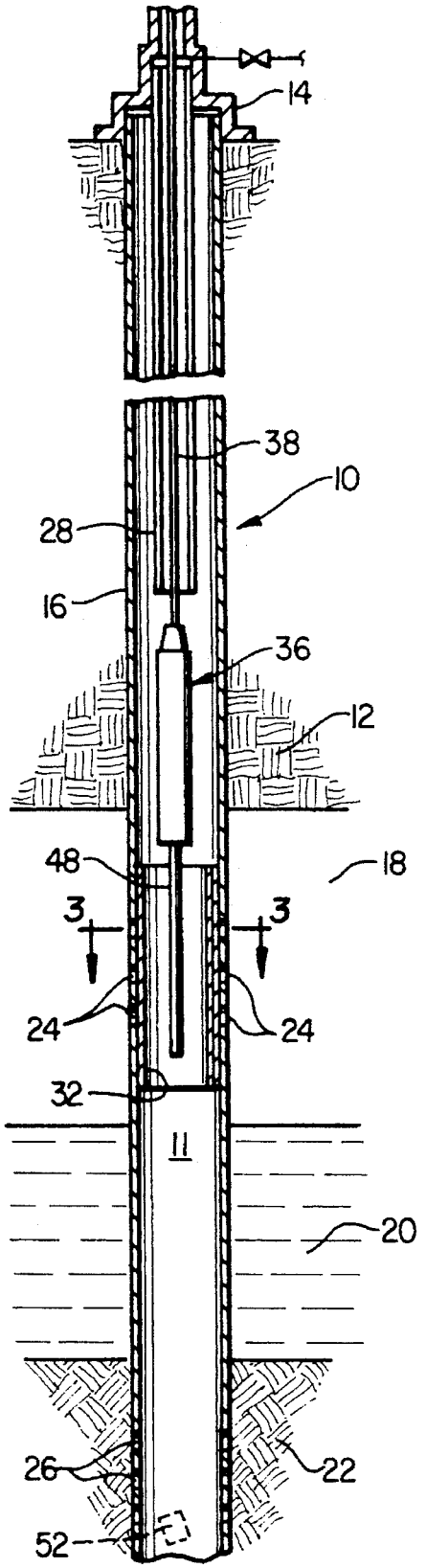
FIG. 1 is a diagram of a well penetrating an earth formation and showing a set of casing perforations which have been blocked by the apparatus of the present invention.

In the description which follows, like parts are marked throughout the specification and drawing with the same reference numerals, respectively. The drawing figures are not necessarily to scale and certain elements are shown in somewhat generalized or schematic form in the interest of clarity and conciseness.

Referring to FIG. 1 there is illustrated, in somewhat schematic form, a well 10 which may be adapted for production of fluids from, and/or injection of fluids into, multiple zones of an earth formation 12. The well 10 includes a conventional wellhead 14 and a casing or liner 16 extending therefrom through plural earth formation zones 18, 20 and 22. The casing 16 is shown perforated into the formation zone 18 at multiple, longitudinally and circumferentially spaced perforations 24. The casing 16 has also been perforated into the formation zone 22 at multiple perforations 26, for example. A tubing string 28 extends from the wellhead 14 at least partially through the well 10 and is in communication with a wellbore space 11.

In many instances, it may be desirable to block the perforations 24 or 26 so that certain operations may be carried out such as injecting fluids into the well 10 to flow through the other set of perforations. If the lower set of perforations 26 is to be blocked, the wellbore may, for example, be filled with an evacuable particulate material, such as sand, to temporarily cover the perforations 26 while fluids are injected into the wellbore 11 to flow through the perforations 24 into the zone 18. On the other hand, if it is desired to block the perforations 24 while injecting fluids into the wellbore 11 to flow through the perforations 26, the wellbore may not, of course, be filled with an evacuable particulate material to block only the perforations 24.

Regardless of which set of perforations is to be blocked, the present invention contemplates a unique method and apparatus for doing so. FIG. 1 shows the condition wherein the set of perforations 24 has been blocked by a unique, elastically-coilable and expansible sleeve member, generally designated by the numeral 32. The sleeve 32 is shown in its deployed position covering the perforations 24 so that certain operations may be carried out to inject fluids into the wellbore 11 to flow through the perforations 26, for example. Moreover, the perforations 24 may be permanently blocked by the expansible sleeve 32 if it is desired to produce fluids only from the set of perforations 26 out of the formation zone 22.

Further illustrated in FIG. 1 is a device for conveying the sleeve 32 to the vicinity of its working position and for deployment of the sleeve into its working position. The device comprises an actuator, generally designated by the numeral 36, and is shown in FIG. 1 deployed into its working position by a tubing 38 which may, for example, comprise conventional coilable tube insertable into the well using conventional equipment known to those skilled in the art of coilable tubing apparatus.

Figure 2:
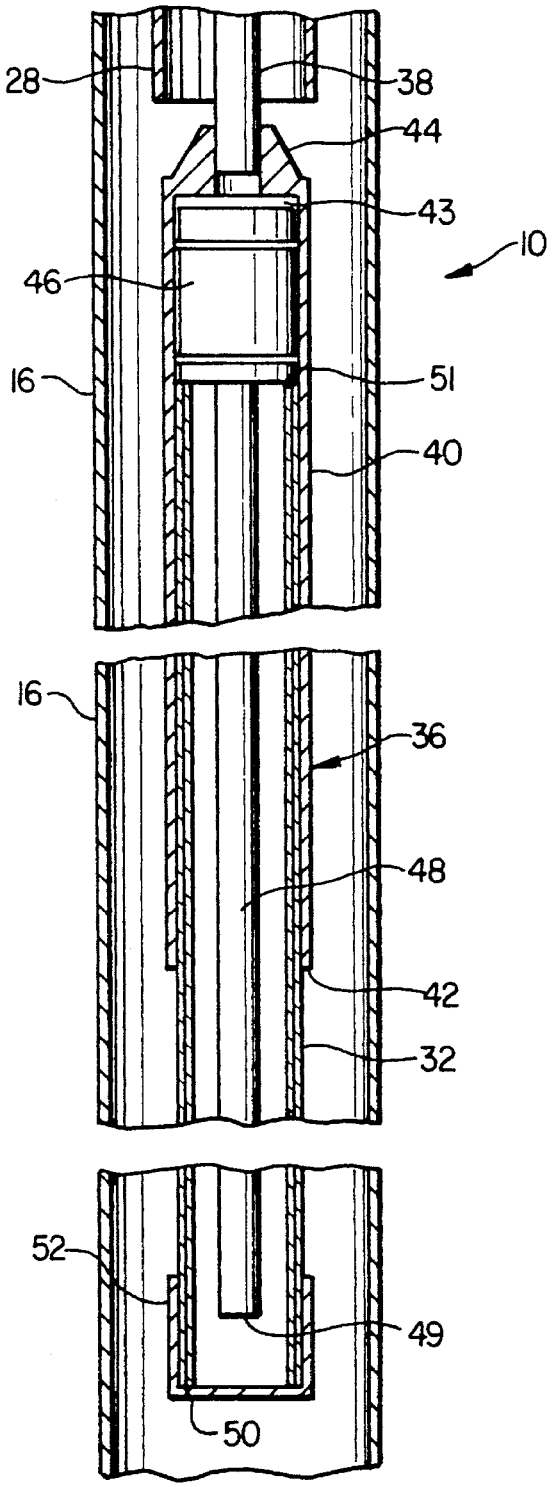
FIG. 2 is a longitudinal central section view showing certain details of the perforation blocking apparatus with the expandable coiled sleeve disposed in its deployment actuator.

Referring also to FIG. 2, certain details of the device 36 are illustrated. In a preferred embodiment of the device 36 it is characterized as an elongated cylinder member 40 having a substantially open distal end 42 and a head part 44 adapted to be connected to the tubing 38. The cylinder 40 may actually be a part of the tubing 38 if it is of sufficient diameter. In FIG. 2, the expansible sleeve 32 is shown disposed in the cylinder 40 and engaged at its upper end with a piston 46 slidably disposed in the cylinder 40. The piston 46 includes a longitudinally- extending rod part 48 which extends through the coiled sleeve 32 and terminates at a distal end 49 slightly above the lower distal end 50 of the sleeve 32 when it is disposed in the device 36. As shown in FIG. 2, in the position of the sleeve 32 wherein it is disposed in the device 36 for conveyance to its working position, the sleeve is retained in a coiled position at its lower end 50 at least partly aided by a generally cylindrical cap 52. As further shown in FIG. 2, the length of the sleeve 32 is greater than the available length of the cylinder 40 to receive the sleeve. The upper end 51 of the sleeve 32 is engaged with the piston 46 and is operable to be displaced from the cylinder 40 upon movement of the piston 46 downwardly, viewing FIG. 2.

Figure 4:
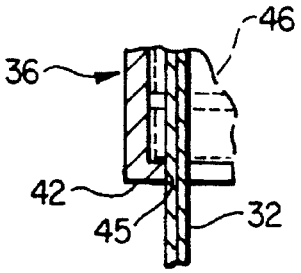
FIG. 4 is a detail view of one end of the sleeve deployment actuator.

The piston 46 may be urged to displace the sleeve 32 from the device 36 under the urging of pressure fluid admitted into a chamber 43 formed in the cylinder 40 between the head part 44 and the piston 46. Pressure fluid may be conveyed down through the tubing 38 to the chamber 43 to urge the piston 46 to rapidly displace the sleeve 32 from the device 36. FIG. 4 is a detail view showing that the lower distal end 42 of the cylinder 40 may be provided with a re-entrant edge 45 engageable with the piston 46 to prevent discharge of the piston 46 from the cylinder 40 when the sleeve 32 is moved downwardly and out of the cylinder to its deployed position.

Figure 3:
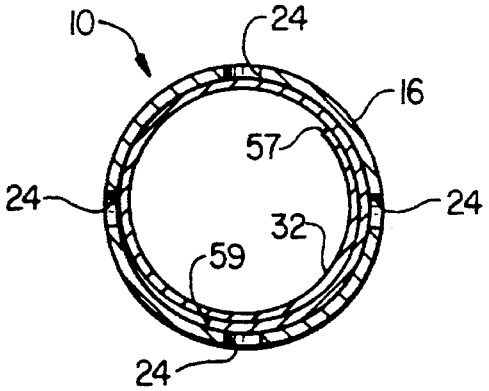
FIG. 3 is a section view taken generally along the line 3—3 of FIG. 1.

The sleeve 32 may be formed of an elastically-deformable material such as heat treatable 17 PH stainless steel, similar elastically-deformable metals or corrosion resistant composites. Still further, the sleeve 32 is coilable into a small enough diameter with overlapping layers of the sleeve so that it may be fitted into the cylinder 40 and be resiliently expandable to engage the walls of the cylinder 40 to retain itself in the position shown in FIG. 2 until displaced from the cylinder by the piston 46. In its unrestrained position, the sleeve 32 is uncoilable or expandable into gripping engagement with the inner wall of the casing 16 as shown in FIG. 3 to block the perforations 24. The overall width of the sleeve 32 in an uncoiled or flat position is such that when it is deployed into its working position, as shown in FIG. 3, there is overlap between the longitudinal side edges 57 and 59 of about one third of a wrap or more so that the sleeve will cover all of the perforations 24. Moreover, the sleeve 32 is more tightly coilable without undergoing plastic deformation so that it may be fitted in the cylinder 40 and in the cap 52. The cap 52 is operable to minimize the tendency for the lower distal end 50 of the sleeve to uncoil since this end is not confined in the cylinder 40 in the position shown in FIG. 2.

When it is desired to deploy the sleeve 32 into the position shown in FIG. 1, the sleeve is coiled tightly enough to be disposed in the cylinder 40, the cap 52 is placed on the lower distal end 50 of the sleeve and the device 36 is connected to the tubing 38 and conveyed into the well 10 through the wellhead 14 and the tubing string 28. The device 36 is spotted just above the set of perforations 24 and pressure fluid is directed into the tubing 38 at a rate and pressure sufficient to rapidly move the piston 46 through the cylinder 40 to expel the sleeve 32. The piston 46 is moved with enough speed such that inertial forces will carry the sleeve 32 just out of the lower distal end 42 of the cylinder 40 even though the piston 46 is preferably arrested by the re-entrant edge 45 before it is completely deployed from the device 36.

As soon as the upper edge 51 of the sleeve 32 leaves the cylinder 40, the sleeve will expand or uncoil radially outwardly into engagement with the inner wall of the casing 16. This action by the sleeve 32 may be sufficient to force the cap 52 off of the lower end of the sleeve 32 allowing that end to uncoil and expand into the working position shown in FIGS. 1 and 3. If, however, the cap 50 is not forcibly removed from the lower distal end 50 of the sleeve 32, the device 36 may be conveyed further downwardly by the tubing 38 until the lower end 49 of the piston rod 48 engages the cap 52 and forces the cap off of the distal end 50 of the sleeve allowing the sleeve to fully expand into its working position. With the sleeve 32 deployed to its working position, the device 36 may be retrieved from the well 10 up through the tubing 28 wherein the well is then ready for further operational exercises to be carried out such as injecting fluids into the formation zone 22 through the perforations 26. At an appropriate time the zone 18 may, if desired, be placed in communication with the wellbore 11 by perforating the sleeve 32 and the casing 16 at a new set of perforations using conventional perforating means, not shown. Alternatively, the sleeve 32, which may be made out of a titanium-steel alloy, may be dissolved by a hydrofluoric acid and/or hydrochloric acid solution, sometimes known as mud acid, to reopen the perforations 24.

Figure 5:
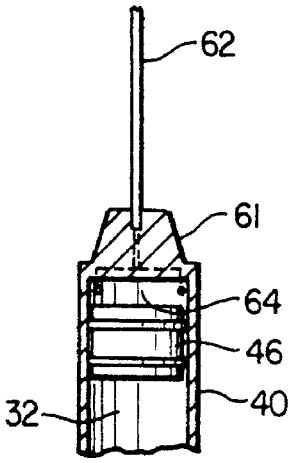
FIG. 5 is a detail view of an alternate embodiment of the sleeve deployment actuator.

Referring now to FIG. 5, there is illustrated a modified cylinder 40 having a head part 61 adapted to be connected to a signal-conducting cable or so-called E-line 62 for deploying the device 36 into the working position shown in FIG. 1. In the modified embodiment shown in FIG. 5, a gas-generating charge material 64 is placed in the cylinder 40 between the piston 46 and the head 61 and is suitably connected to an ignition source, such as an electrical potential, which may be conveyed to the charge material through the E-line 62. Upon energization of the gas-generating material 64, pressure gas will rapidly urge the piston 46 downwardly in the same manner as in the embodiment illustrated in FIG. 2 to deploy the sleeve 32 into its working position. As previously mentioned the actuator may include a pump or other suitable source of pressure fluid or other electrically energized actuating device.

Figure 6:
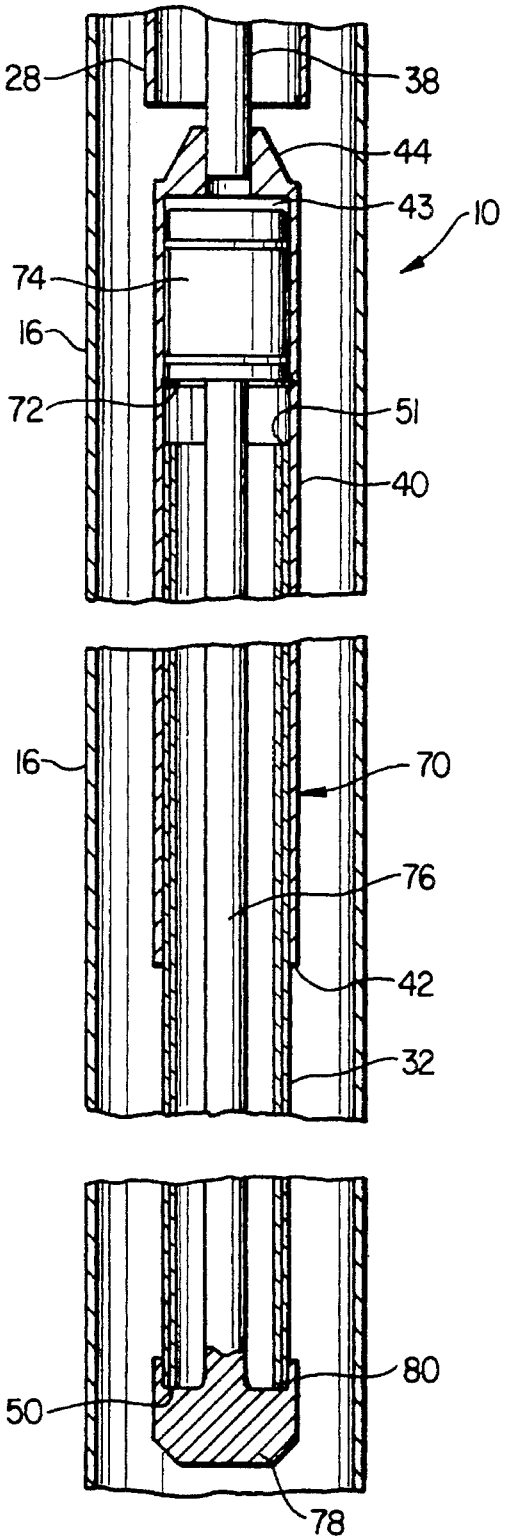
FIG. 6 is a central section view similar to FIG. 2 showing another embodiment of the invention.

Referring now the FIG. 6, another embodiment of the invention is illustrated wherein a modified actuator device 70 is connected to the tubing 38 and is characterized by a cylinder 40 having a head portion 44 which is connected to the tubing 38 in the same manner as for the embodiment of FIG. 2. In the embodiment of FIG. 6 the cylinder 40 has been modified to receive a shearable retaining ring 72 within the cylinder bore for retaining a piston 74, similar to the piston 46, in the position shown in the drawing figure. An elongated piston rod 76 is connected to the piston 74 and extends to a nose part 78 having an integral collar portion 80 for containing the lower distal end 50 of the sleeve 32. As shown in FIG. 6 the upper end 51 of the sleeve 32 is displaced from the piston 74 when the sleeve is assembled within the cylinder 40. The sleeve 32, of course, has a tendency to expand radially outwardly and is in engagement with the cylinder 40 whereby a certain amount of friction force must be overcome to displace the sleeve from the device 70.

In the operation of the device 70, the piston 74 is retained from inadvertent actuation by the retaining ring 72. However, upon buildup of fluid pressure in the chamber 43 the piston 74 will move downwardly overcoming the retaining effect of the retaining ring 72 and also moving nose part 78 away from the lower distal end 50 of the sleeve 32, since the sleeve will be retained in the cylinder by friction forces. Alternatively, the sleeve 32 may be retained in the cylinder 40 by a suitable shear pin or the like, not shown. As the piston 74 moves downwardly it will engage the distal end 51 of the sleeve 32 after the lower distal end 50 of the sleeve has been released from the nose part 78 and has begun to expand radially outwardly. Continued downward movement of the piston 74 will deploy the sleeve 32 from the actuator device 70 in a manner similar to the embodiment of FIG. 2.

As also previously mentioned the sleeve 32 may be formed of a suitable elastically deformable material of sufficient strength to undergo the elastic deflection and expansion required of the sleeve and to also withstand fluid pressures acting against the sleeve across the old perforations 24 when the sleeve is in its working position. A suitable sleeve might, for example, be formed of sixteen gauge to eighteen gauge 17 PH heat-treatable stainless steel having a length between distal ends 50 and 51 of about 20 feet. The unrolled width of the material should be sufficient, as previously mentioned, to provide an overlap of the longitudinal side edges 57 and 59 sufficient to be sure that all perforations 24 will be blocked regardless of the rotative position of the sleeve in the well.

Although a preferred embodiment of the present invention has been described in some detail hereinabove, those skilled in the art will recognize that various substitutions and modifications may be made to the embodiments described without departing from the scope and spirit of the invention set forth in the appended claims.

What is claimed is:

1. A method for blocking at least one of perforations, cracks and voids in a well casing comprising the steps of:

deploying a radially expansible sleeve into said well casing in the vicinity of said one of said perforations, cracks and voids, said sleeve having overlapping longitudinal side edges in a coiled condition of a diameter less than said casing and in an expanded condition in engagement with the wall of said casing; and allowing said sleeve to expand into engagement with said wall of said casing and covering said one of said perforations, cracks and voids in said casing to block the flow of fluid between an earth formation zone in communication with said one of said perforations, cracks and voids and said well.

2. The method set forth in claim 1 wherein:

the step of deploying said sleeve comprises placing a device in said well which contains said sleeve in a coiled condition and ejecting said sleeve from said device to allow said sleeve to uncoil into engagement with said wall of said casing.

3. The method set forth in claim 2 wherein:

said device includes a cylinder for containing said sleeve in said coiled condition and a piston disposed in said cylinder and engageable with one end of said sleeve for ejecting said sleeve from said device to allow said sleeve to uncoil into engagement with said wall of said casing.

4. The method set forth in claim 3 wherein:

said piston is urged to eject said sleeve from said cylinder by pressure fluid conveyed to said device by a tubing connected to said device for deploying said device in said working position.

5. The method set forth in claim 3 wherein:

said device includes a gas-generating charge material disposed in said cylinder and operable to be energized to generate a gas charge to urge said piston to eject said sleeve from said cylinder.

6. The method set forth in claim 1 including the step of:

forming a set of perforations in said casing and through said sleeve to place said well in communication with a selected zone of an earth formation penetrated by said well.

7. The method set forth in claim 1 including the step of:

chemically dissolving said sleeve to place said well in communication with a selected zone of an earth formation penetrated by said well.

8. For use in blocking a set of perforations, a crack or void in a well casing to prevent communication between a wellbore of said well and a selected zone of an earth formation penetrated by said well, an apparatus comprising:

an elongated, elastically-expansible sleeve formed by a coiled plate member having overlapping longitudinal side edges;

a device forming a cylinder for containing said sleeve in a tightly coiled condition of said sleeve which will provide for elastic expansion of said sleeve when removed from said cylinder; and a piston for ejecting said sleeve at will from said cylinder to deploy said sleeve into engagement with a wellbore wall to block communication of fluid between said wellbore and said zone.

9. The apparatus set forth in claim 8 including:

a cap disposed over a distal end of said sleeve extending from said cylinder to minimize the tendency for said sleeve to expand at said one end when said sleeve is disposed in said cylinder.

10. The apparatus set forth in claim 9 wherein:

said piston includes an elongated longitudinally-extending rod portion operable to engage said cap to forcibly remove said cap from said one end of said sleeve.

11. The apparatus set forth in claim 9 wherein:

said cap is connected to an elongated rod portion connected to said piston, and said piston is operable to displace said cap from said distal end of said sleeve and eject said sleeve from said cylinder.

12. The apparatus set forth in claim 8 including:

means for communicating pressure fluid to said cylinder to urge said piston to eject said sleeve from said cylinder.

13. The apparatus set forth in claim 12 wherein:

said means for communicating pressure fluid comprises a tubing string operably connected to said cylinder.

14. The apparatus set forth in claim 12 wherein:

said means for communicating pressure fluid comprises gas-generating charge material disposed in said cylinder and said apparatus includes a signal-conducting cable connected to said cylinder and electrically connected to said charge material to effect generation of pressure gas to urge said piston to eject said sleeve.

* * * * *